US010563653B2

(12) United States Patent
Ribarov et al.

(10) Patent No.: US 10,563,653 B2
(45) Date of Patent: Feb. 18, 2020

(54) GEAR PUMP

(71) Applicant: Hamilton Sundstrand Corporation, Charlotte, NC (US)

(72) Inventors: Lubomir A. Ribarov, West Hartford, CT (US); James S. Elder, Jr., South Windsor, CT (US); Leo J. Veilleux, Jr., Wethersfield, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 906 days.

(21) Appl. No.: 14/993,891

(22) Filed: Jan. 12, 2016

(65) Prior Publication Data

US 2017/0198693 A1 Jul. 13, 2017

(51) Int. Cl.
*F04C 15/00* (2006.01)
*F04C 2/08* (2006.01)

(52) U.S. Cl.
CPC ..... *F04C 15/0042* (2013.01); *F04C 2/08* (2013.01); *F04C 2/088* (2013.01)

(58) Field of Classification Search
CPC .... F04C 2/088; F04C 2/18; F04C 2210/1044; F04C 2240/56; F16C 2360/42; Y10T 29/49236
USPC ..... 418/190, 191, 206.7
See application file for complete search history.

(56) References Cited

U.S. PATENT DOCUMENTS 2,029,742 A * 4/1935 Sieverts ..... 418/72
2,344,628 A * 3/1944 Monahan ..... F04C 2/084 418/190
2,601,003 A * 6/1952 Pontius ..... F04C 2/084 418/190
3,953,160 A * 4/1976 Bottoms ..... F04C 2/084 418/190
3,981,646 A 9/1976 Bottoms
4,233,005 A 11/1980 Bottoms et al.
4,290,739 A 9/1981 Korse
6,123,533 A 9/2000 McBurnett et al.
7,481,633 B2 1/2009 White, Jr.
7,654,806 B2 2/2010 Hanst et al.
7,878,781 B2 2/2011 Elder
8,137,085 B2 3/2012 Ni et al.
8,512,018 B2 8/2013 Jordan et al.
(Continued)

FOREIGN PATENT DOCUMENTS

EP 1406015 A1 4/2004

OTHER PUBLICATIONS

Manufacturing of cylindrical gears by generating cutting processes: A critical synthesis of analysis methods (Year: 2008).*
(Continued)

*Primary Examiner* — Mary Davis
*Assistant Examiner* — Dapinder Singh
(74) *Attorney, Agent, or Firm* — Cantor Colburn LLP

(57) ABSTRACT

A pump includes first and second gears coupled to one-another for rotation about respective axis. The first gear may include a concentrically disposed first hub portion and a plurality of first teeth radially projecting and circumferentially spaced about the first hub portion. A plurality of first recesses are defined by the first hub portion, communicate radially outward, and are circumferentially distributed about the first hub portion between adjacent teeth of the plurality of first teeth.

16 Claims, 3 Drawing Sheets

(56) References Cited

U.S. PATENT DOCUMENTS

| | | | |
|---|---|---|---|
| 8,944,793 | B2 | 2/2015 | Ni |
| 9,057,372 | B2 | 6/2015 | Wakefield et al. |
| 9,068,568 | B2 | 6/2015 | Heitz et al. |
| 2005/0112012 | A1 | 5/2005 | Marheineke |
| 2012/0219449 | A1 | 8/2012 | Ni et al. |

OTHER PUBLICATIONS

Extended European Search Report for application No. 17151112.
4-1616 dated Mar. 10, 2017 (7 pages).

* cited by examiner

GEAR PUMP

BACKGROUND

The present disclosure relates to a gear pump, and more particularly, to a gear pump with cavitation reducing gears.

In one example of a gear pump, aircraft gas turbine engines receive pressurized fuel from gear-type fuel pumps. The gear pump typically performs over a wide operational speed range while providing needed fuel flows and pressures for various engine performance functions.

Gear pumps often comprise two coupled gears of similar configuration and size that mesh with each other inside an enclosed gear housing. A drive gear may be connected rigidly to a drive shaft. As the drive gear rotates, it meshes with a driven gear thus rotating the driven gear. As the gears rotate within the housing, fluid is transferred from an inlet to an outlet of the gear pump. Typically, the drive gear carries the full load of the gear pump drive or input shaft. The two gears may operate at high loads and high pressures, which may stress the gear teeth.

The volume of fluid pumped through the gear pump may partially depend on the geometry of the tooth (e.g., depth, profile, etc.), the tooth count, and the width of the gear. Larger volumetric output may be achieved when lower gear tooth counts with large working tooth depths and face width are used. Alternatively, higher volumetric output may be achieved with higher rotational speed of the pump. Most gear pumps have gears with about ten to sixteen teeth. As the gears rotate, individual parcels of fluid are released between the teeth to the outlet. A common problem with more traditional gear pumps operating at high rotational speeds is cavitation erosion of the surfaces of the gear teeth. Cavitation erosion results in pitting of surfaces of the gear teeth that may eventually result in degraded pump volumetric capacity and affect pump operability and durability.

SUMMARY

A pump according to one, non-limiting, embodiment of the present disclosure includes a first gear constructed and arranged to rotate about a first axis, the first gear including a concentrically disposed first hub portion and a plurality of first teeth radially projecting and circumferentially spaced about the first hub portion, wherein a plurality of first recesses are defined by the first hub portion, communicate radially outward, and are circumferentially distributed about the first hub portion between adjacent teeth of the plurality of first teeth; and a second gear operably coupled to the first gear for rotation about a second axis.

Additionally to the foregoing embodiment, the pump is a fuel pump.

In the alternative or additionally thereto, in the foregoing embodiment, the first gear is a driven gear and the second gear is a driving gear.

In the alternative or additionally thereto, in the foregoing embodiment, the second gear includes a concentrically dispose second hub portion and a plurality of second teeth radially projecting and circumferentially spaced about the second hub portion, and wherein a plurality of second recesses are defined by the second hub portion, communicate radially outward, and are circumferentially distributed about the second hub portion between adjacent teeth of the plurality of second teeth.

In the alternative or additionally thereto, in the foregoing embodiment, the first gear includes opposite, axially, facing sidewalls carried by the first hub portion and the plurality of first teeth, and wherein the plurality of first recesses does not communicate through the sidewalls.

In the alternative or additionally thereto, in the foregoing embodiment, the plurality of first recesses is equivalent to the plurality of first teeth.

In the alternative or additionally thereto, in the foregoing embodiment, the plurality of first recesses is about half the plurality of first teeth, and the plurality of second recesses is about half the plurality of second teeth.

In the alternative or additionally thereto, in the foregoing embodiment, the plurality of first recesses is equivalent to the plurality of first teeth, and the plurality of second recesses is equivalent to the plurality of second teeth.

A gear pump according to another, non-limiting, embodiment includes a drive shaft constructed and arranged to rotate about a first axis; a coupling shaft constructed and arranged to rotate about a second shaft; a main drive gear mounted to the drive shaft; a main driven gear mounted to the coupling shaft and coupled to the main drive gear; a motive drive gear mounted to the coupling shaft; a motive driven gear coupled to the motive drive gear for rotation about a third axis; and wherein each of the gears include a hub portion projecting radially outward from the respective axis and a plurality of teeth projecting radially outward from and circumferentially spaced about the hub portion, and wherein at least one of the hub portions include a plurality of recesses with each recess of the plurality of recesses disposed between respective adjacent teeth of the plurality of teeth.

Additionally to the foregoing embodiment, each of the hub portions include the plurality of recesses.

In the alternative or additionally thereto, in the foregoing embodiment, the first axis is parallel to the second axis.

In the alternative or additionally thereto, in the foregoing embodiment, the second axis is parallel to the third axis.

In the alternative or additionally thereto, in the foregoing embodiment, the gear pump is a gear fuel pump.

In the alternative or additionally thereto, in the foregoing embodiment, the gear fuel pump is part of an aircraft engine fuel system.

A gear for rotation about an axis according to another, non-limiting, embodiment includes a substantially cylindrical hub portion including a first sidewall, an opposite second sidewall, and a circumferentially continuous face spanning axially between the first and second sidewalls; a plurality of teeth circumferentially spaced about and projecting radially outward from the face; and a plurality of recesses defined by the face with each recess disposed between respective adjacent teeth of the plurality of teeth.

Additionally to the foregoing embodiment, the plurality of recesses do not communicate through the first and second sidewalls.

In the alternative or additionally thereto, in the foregoing embodiment, the gear is a spur gear.

In the alternative or additionally thereto, in the foregoing embodiment, the fear is a helical gear.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
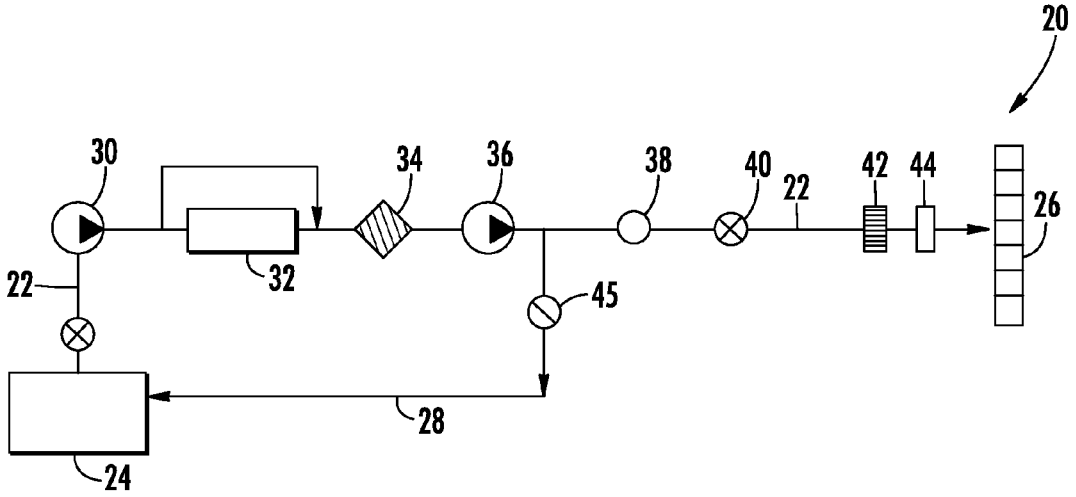
FIG. 1 is a schematic of an aircraft fuel system as one, non-limiting, example of an application of a gear pump of the present disclosure.

Referring to FIG. 1, one embodiment of a fuel system 20 of the present disclosure is illustrated. The fuel system 20 may be an aircraft fuel system and may include a fuel supply line 22 that may flow liquid fuel from a fuel tank 24 to fuel nozzles 26 of an engine (not shown). A fuel bypass line 28 may be arranged to divert fuel from the supply line 22 and back to the fuel tank 24. Various fuel system components may interpose the fuel supply line 22 and may include a low pressure fuel pump 30, a heat exchanger 32, a fuel filter 34, a high pressure fuel pump 36, a metering valve 38, a high pressure fuel shutoff valve 40, a screen 42, a fuel flow sensor 44, and a fuel tank shutoff valve 45. The low pressure fuel pump 30 may be located downstream of the fuel tank 24. The heat exchanger 32 may be located downstream of the low pressure fuel pump 30. The fuel filter 34 may be located downstream of the heat exchanger 32. The high pressure fuel pump 36 may be located downstream of the fuel filter 34 and upstream of the fuel bypass line 28. The metering valve 38 may be located downstream from the bypass line 28. The high pressure fuel shutoff valve 40 may be located downstream from the bypass line 28. The screen 42 may be located downstream from the high pressure fuel shutoff valve 40, and the fuel flow sensor 44 may be located downstream from the screen 42. It is further contemplated and understood that other component configurations of a fuel system are applicable and may further include additional sensors, valves and other components.

The heat exchanger 32 may be adapted to use the flowing fuel as a heat sink to cool other liquids flowing from any variety of auxiliary systems of an aircraft and/or the engine. For example, the heat exchanger 32 may transfer heat from an oil and to the fuel. The oil may be used to lubricate any variety of auxiliary components including, for example, a gear box (not shown) of the engine. Such a transfer of heat may elevate the temperature of the fuel which may make the high pressure fuel pump 36 more prone to cavitation.

Figure 2:
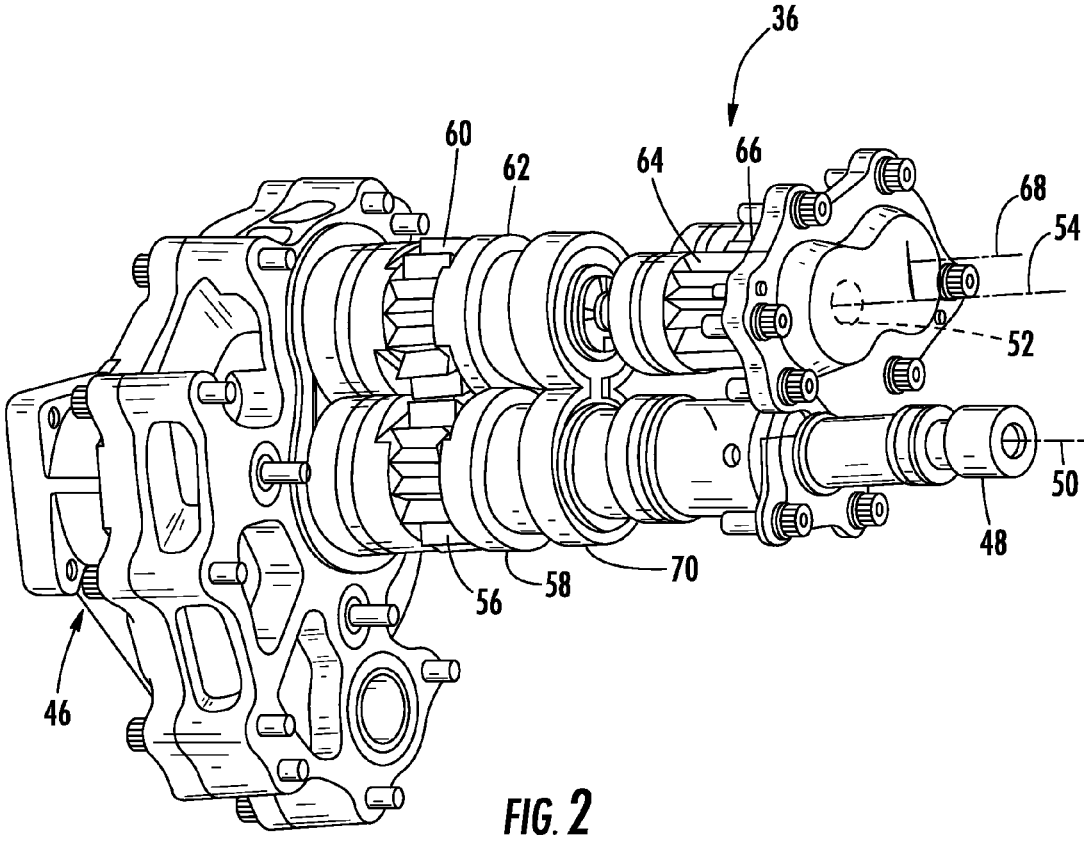
FIG. 2 is a perspective view of the gear pump with a housing removed to show internal detail.
Figure 3:
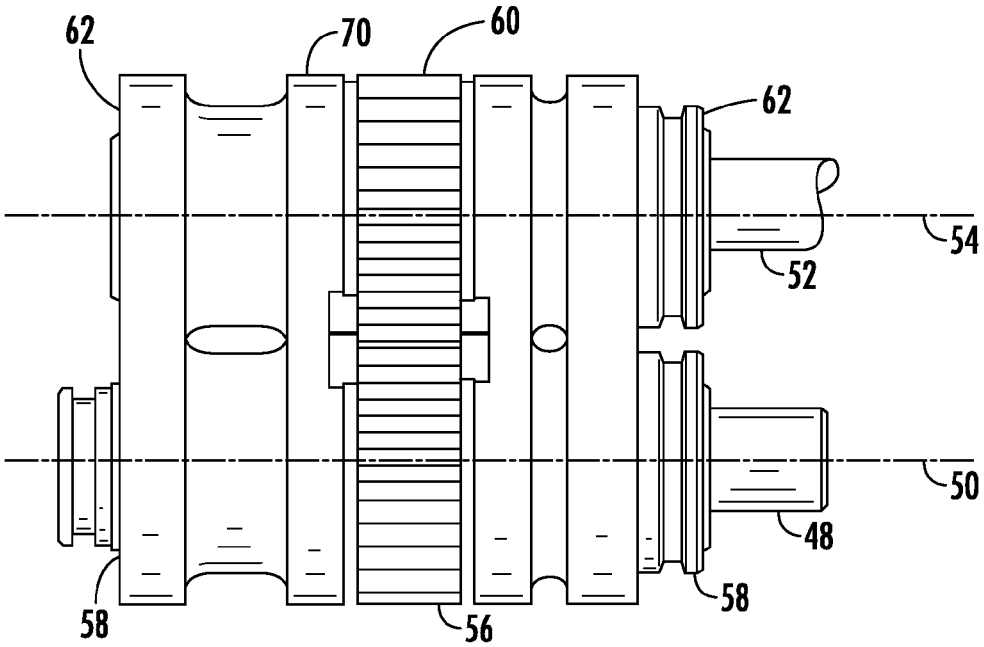
FIG. 3 is a side view of coupled gears and associated bearings of the gear pump.

Referring to FIGS. 2 and 3, one non-limiting example of the high pressure fuel pump 36 is illustrated as a gear pump with a housing removed to show internal detail. The gear pump 36 may be a dual stage pump and may include an accessory gear box 46, an input drive shaft 48 constructed for rotation about a first axis 50, a coupling shaft 52 constructed for rotation about a second axis 54, a drive gear 56 with associated bearings 58, a driven gear 60 with associated bearings 62, a motive drive gear 64 and a motive driven gear 66 configured for rotation about a third axis 68. The axis 50, 54, 68 may be substantially parallel to one-another. The accessory gear box 46 may provide the rotational power to the drive shaft 48. The drive gear 56 is engaged and concentrically disposed to the drive shaft 48. The driven gear 60 and motive drive gear 64 are engaged and concentrically disposed to the coupling shaft 52. The drive and driven gears 56, 60 are rotationally coupled to one another for the pumping (i.e., displacement) of fuel as a first stage, and the motive drive gear 64 and motive driven gear 66 are rotationally coupled to one another for the continued pumping of the fuel as a second stage. It is further contemplated and understood that many other types of gear pumps may be applicable to the present disclosure. For example, the gear pump may be a single stage gear pump, and/or the accessory gear box 46 may be replaced with any other device capable of rotating the drive shaft 48 (e.g., electric motor).

The bearings 58, 62 may be inserted into a common carrier 70 that generally resembles a figure eight. A gear bearing face geometry, known in the art as a "bridge land" may be sculpted to minimize cavitation and pressure ripple that may deteriorate the integrity of the pump components.

In operation, the gear pump 36 is capable of providing fuel at a wide range of fuel volume/quantity and pressures for various engine performance functions. The accessory gear box 46 provides rotational power to the drive shaft 48 which, in-turn, rotates the connected drive gear 56. The drive gear 56 then drives (i.e., rotates) the driven gear 60 that rotates the coupling shaft 52. Rotation of the coupling shaft 52 rotates the motive drive gear 64 that, in-turn, rotates the motive driven gear 66.

Figure 4:
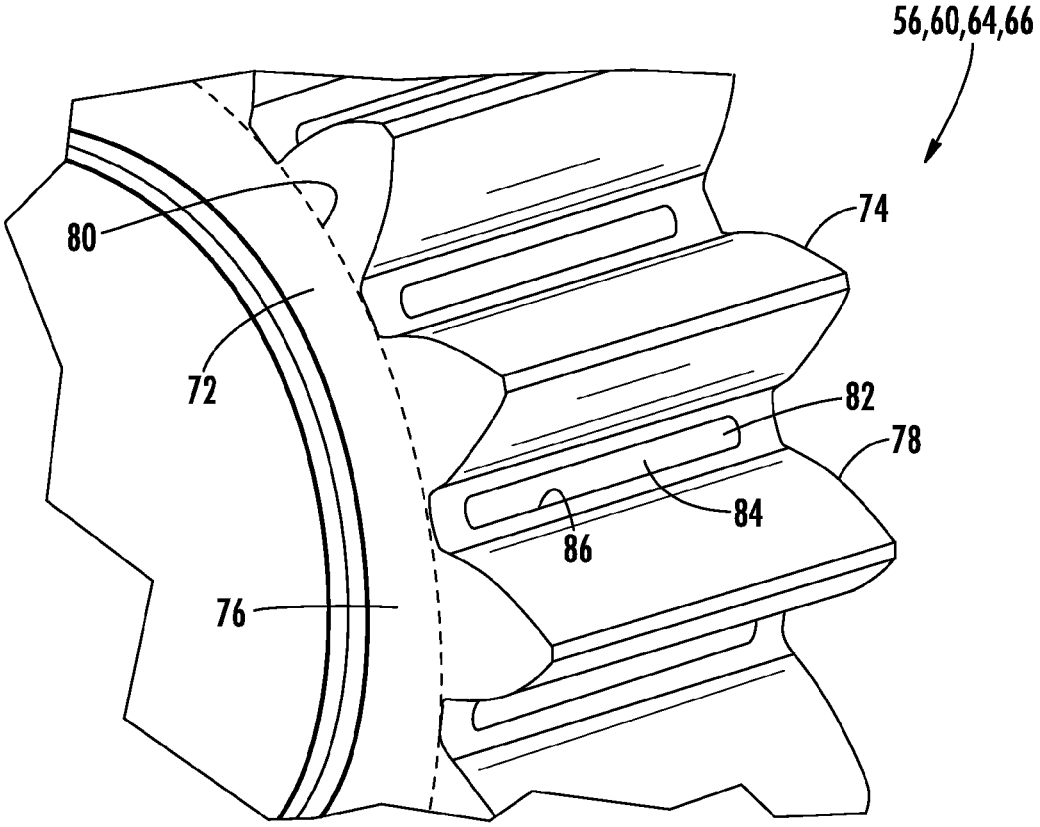
FIG. 4 is a partial perspective view of one of the coupled gears.
Figure 5:
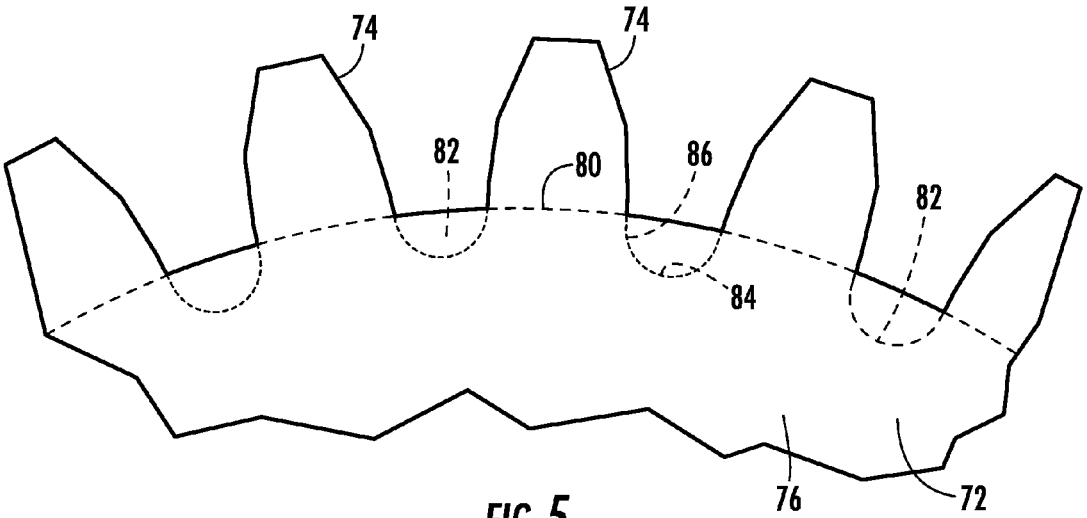
FIG. 5 is a partial side view of the gear.

Referring to FIGS. 4 and 5, each of the gears 56, 60, 64, 66, may include a hub portion 72 and a plurality of teeth 74 that may both span axially between two opposite facing sidewalls 76, 78. Each sidewall 76, 78 may lay within respective imaginary planes that are substantially parallel to one-another. The hub portion 72 may be disc-like and projects radially outward from the respective shafts 48, 52 and/or axis 50, 54, 68 to a circumferentially continuous face 80 generally carried by the hub portion 72. The face 80 may generally be cylindrical. The plurality of teeth 74 project radially outward from the face 80 of the hub portion 72 and are circumferentially spaced about the hub portion 72. The gears 56, 60, 64, 66 may be spur gears, helical gears or other types of gears with meshing teeth, and/or combinations thereof.

Any one or all of the gears 56, 60, 64, 66 may include a plurality of recesses 82 (i.e., depressions) in the hub portion 72 that facilitate a reduction or elimination of cavitation. Each recess 82 may be located between adjacent teeth of the plurality of teeth 74 and communicates radially outward through the face 80 of the hub portion 72 without communicating through the sidewalls 76, 78. That is, each recess 82 may generally be defined by the face 80. More specifically, each recess 82 may include boundaries generally defined by a bottom segment 84 and a continuous peripheral segment 86 of the face 80 that circumvents the bottom segment 84. For any one gear 56, 60, 64, 66, the number of recesses 82 may be equivalent to the number of teeth 74 (i.e., a recess is located between each and every two adjacent teeth). Alternatively, the number of recesses 82 may be half the number of teeth 74 (i.e., a recess is located between two adjacent pairs of teeth, or adjacent to every other tooth).

During operation of the fuel system 20 as one example, aircraft fuel may be heated by the heat exchanger 32 to temperatures as high as about 500° F. (260° C.) at pressures that may reach 1000 psi (7 MPa). This heated fuel may enter the high pressure pump 36 and is further increased in pressure (at a controlled flow) via the un-meshing and re-meshing of the teeth 74 of the coupled gears 56, 60 and or gears 64, 66. The recesses 82 prevent the cavitation (i.e., implosion) that may occur when the high temperature fuel flashes into a vapor phase during un-meshing of the teeth 82 and the resulting vapor bubbles collapse onto the gear surfaces during the gear re-meshing. The recesses 82 provide an additional volume for expansion of the two-phase fuel/fuel vapor flow.

Benefits of the present disclosure include a reduction or elimination of cavitation near a surface of the gear teeth 74 while preserving the axial and radial balance of each gear 56, 60, 64, 66. Such preservation may enable gear replacement of existing gear assemblies that do not have such recesses. Because the recesses 82 do not break through the sidewalls 76, 78, the design of adjacent bearings (e.g., bearings 58, 62) is not impacted (i.e., gear-face-to-bearing-contact area). Therefore, an increased gear size to meet gear-to-bearing seal-lap length is not required. The depth of the recesses 82 may be more than double the depth of more traditional slots that project through gear sidewalls, thereby increasing fluid volume accumulator and fuel vapor expansion effect so as to further reduce cavitation and allow increased gear velocities that may reduce gear size and weight.

While the present disclosure is described with reference to illustrated embodiments, it will be understood by those skilled in the art that various changes may be made and equivalents may be substituted without departing from the scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. A pump comprising:

a first gear constructed and arranged to rotate about a first axis, the first gear including a concentrically disposed first hub portion and a plurality of first teeth radially projecting and circumferentially spaced about the first hub portion, wherein a plurality of first recesses are defined by the first hub portion, communicate radially outward, and are circumferentially distributed about the first hub portion between adjacent teeth of the plurality of first teeth, and the first gear includes opposite, axially, facing sidewalls carried by the first hub portion and the plurality of first teeth, wherein the plurality of first recesses are located between and do not communicate through either of the sidewalls; and a second gear operably coupled to the first gear for rotation about a second axis.

2. The pump set forth in claim 1, wherein the pump is a fuel pump.

3. The pump set forth in claim 1, wherein the first gear is a driven gear and the second gear is a driving gear.

4. The pump set forth in claim 1, wherein the second gear includes a concentrically disposed second hub portion and a plurality of second teeth radially projecting and circumferentially spaced about the second hub portion, and wherein a plurality of second recesses are defined by the second hub portion, communicate radially outward, and are circumferentially distributed about the second hub portion between adjacent teeth of the plurality of second teeth.

5. The pump set forth in claim 4, wherein the plurality of first recesses is about half the plurality of first teeth, and the plurality of second recesses is about half the plurality of second teeth.

6. The pump set forth in claim 4, wherein the plurality of first recesses is equivalent to the plurality of first teeth, and the plurality of second recesses is equivalent to the plurality of second teeth.

7. The pump set forth in claim 1, wherein the plurality of first recesses is equivalent to the plurality of first teeth.

8. A gear pump comprising:

a drive shaft constructed and arranged to rotate about a first axis;

a coupling shaft constructed and arranged to rotate about a second axis;

a main drive gear mounted to the drive shaft;

a main driven gear mounted to the coupling shaft and coupled to the main drive gear;

a motive drive gear mounted to the coupling shaft;

a motive driven gear coupled to the motive drive gear for rotation about a third axis; and wherein each of the gears include a hub portion projecting radially outward from the respective axis and a plurality of teeth projecting radially outward from and circumferentially spaced about the hub portion, and wherein at least one of the hub portions include a plurality of recesses with each recess of the plurality of recesses disposed between respective adjacent teeth of the plurality of teeth, and wherein each one of the plurality of recesses are located between and do not communicate through either of the opposite axially facing sidewalls.

9. The gear pump set forth in claim 8, wherein each of the hub portions include the plurality of recesses.

10. The gear pump set forth in claim 9, wherein the gear pump is a gear fuel pump.

11. The gear pump set forth in claim 8, wherein the first axis is parallel to the second axis.

12. The gear pump set forth in claim 11, wherein the second axis is parallel to the third axis.

13. The gear pump set forth in claim 11, wherein the gear fuel pump is part of an aircraft engine fuel system.

14. A gear for rotation about an axis, the gear comprising:

a substantially cylindrical hub portion including a first sidewall, an opposite second sidewall, and a circumferentially continuous face spanning axially between the first and second sidewalls;

a plurality of teeth circumferentially spaced about and projecting radially outward from the face; and a plurality of recesses defined by the face with each recess disposed between respective adjacent teeth of the plurality of teeth, wherein the plurality of recesses are located between and do not communicate through either of the first and second sidewalls.

15. The gear set forth in claim 14, wherein the gear is a spur gear.

16. The gear set forth in claim 14, wherein the gear is a helical gear.

* * * * *